US010825283B2

(12) United States Patent
Varley et al.

(10) Patent No.: US 10,825,283 B2
(45) Date of Patent: Nov. 3, 2020

(54) ARTICLE DISPENSING APPARATUS

(71) Applicant: DRESSCODE SYSTEMS LIMITED, Buckinghamshire (GB)

(72) Inventors: John Varley, Devon (GB); Philip Varley, London (GB)

(73) Assignee: DRESSCODE SYSTEMS LIMITED, Buckinghamshire (GB)

( * ) Notice: Subject to any disclaimer, the term of this patent is extended or adjusted under 35 U.S.C. 154(b) by 0 days.

(21) Appl. No.: 15/534,639

(22) PCT Filed: Dec. 9, 2015

(86) PCT No.: PCT/GB2015/053766
§ 371 (c)(1),
(2) Date: Jun. 9, 2017

(87) PCT Pub. No.: WO2016/092298
PCT Pub. Date: Jun. 16, 2016

(65) Prior Publication Data

US 2017/0365123 A1 Dec. 21, 2017

(30) Foreign Application Priority Data

Dec. 10, 2014 (GB) ..... 1421981.0

(51) Int. Cl.
*G07F 11/50* (2006.01)
*G07F 11/58* (2006.01)
(Continued)

(52) U.S. Cl.
CPC ..... *G07F 11/50* (2013.01); *B65B 35/44* (2013.01); *G07F 11/52* (2013.01); *G07F 11/58* (2013.01); *B65H 1/08* (2013.01)

(58) Field of Classification Search
CPC combination set(s) only.
See application file for complete search history.

(56) References Cited

U.S. PATENT DOCUMENTS 1,439,702 A * 12/1922 Haseltine ..... F26B 15/14
198/803.14
2,704,614 A * 3/1955 St. John et al. ..... A21B 3/18
414/415

(Continued)

FOREIGN PATENT DOCUMENTS

FR 2 871 453 12/2005
FR 2 993 763 1/2014

(Continued)

OTHER PUBLICATIONS

Search Report issued in corresponding United Kingdom Patent Application No. 1421981.0 dated Jun. 11, 2015.

(Continued)

*Primary Examiner* — Gene O Crawford
*Assistant Examiner* — Kelvin L Randall, Jr.
(74) *Attorney, Agent, or Firm* — Whiteford, Taylor & Preston, LLP; Peter J. Davis

(57) ABSTRACT

There is disclosed an article dispensing apparatus (10) comprising: an endless conveyor (18) having a plurality of moveable compartments (24) each defined by a pair of adjacent dividers (22) coupled to the conveyor (18), at least a part of each divider (22) being pivotable between at least a closed position in which it cooperates with an adjacent divider (22) to restrict access to the compartment (24) defined therebetween, and an open position in which it is spaced from the said adjacent divider (22) for dispensing an article received in the said compartment (24); and a guide arrangement (34) capable of causing pivoting movement of each divider (22) between at least the closed position and the open positions.

19 Claims, 7 Drawing Sheets

Figure 1:
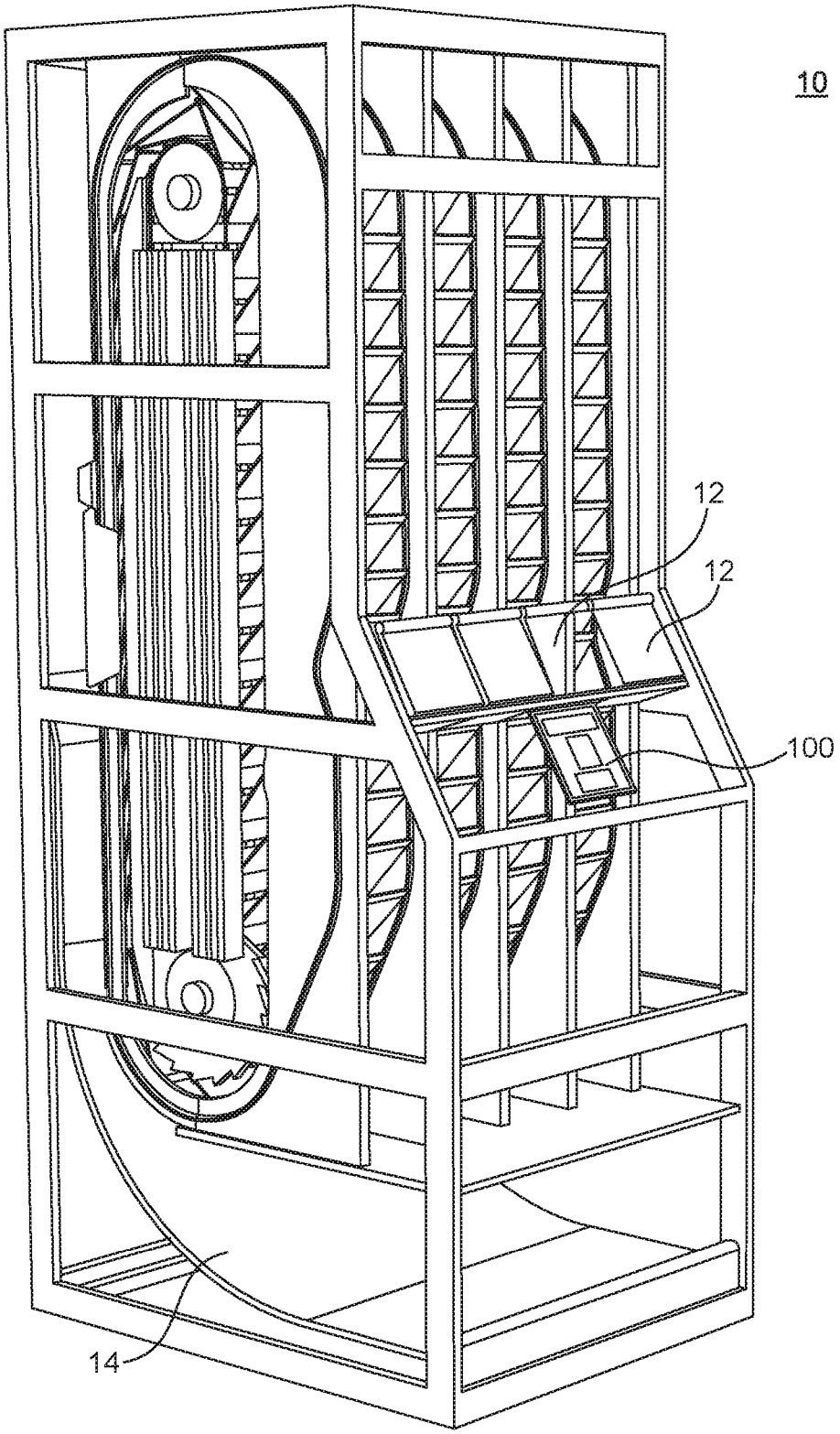

(51) Int. Cl.

| | |
|---|---|
| ***B65B 35/44*** | (2006.01) |
| ***B65H 1/08*** | (2006.01) |
| ***G07F 11/52*** | (2006.01) |

(56) References Cited

U.S. PATENT DOCUMENTS 3,012,653 A * 12/1961 Schramm ..... G07F 11/58 198/801
3,057,512 A * 10/1962 Shurtz ..... G07F 11/58 194/240
3,164,294 A 1/1965 Phillips et al.
3,608,775 A * 9/1971 Offutt ..... A47F 3/08 221/84
3,616,965 A * 11/1971 Bendl ..... G07F 11/58 221/84
3,664,482 A * 5/1972 Kornylak ..... B65G 17/123 198/802
3,722,743 A 3/1973 Atchley
4,399,905 A * 8/1983 Lance ..... B65G 47/082 198/430
5,127,209 A 7/1992 Hunter
5,226,641 A * 7/1993 Schieleit ..... B65H 29/40 271/187
5,413,324 A * 5/1995 Flade ..... B65H 29/041 271/204
5,664,407 A * 9/1997 Cooper, III ..... B65B 23/12 53/244
5,671,867 A * 9/1997 Cardenas ..... G07F 11/58 198/803.13
5,934,670 A * 8/1999 Todoki ..... B65H 29/38 198/680
6,203,000 B1 * 3/2001 Hill ..... B65G 17/326 209/534
6,854,815 B1 2/2005 Smith
2008/0011771 A1 * 1/2008 Roekens ..... G07F 11/24 221/253
2013/0206785 A1 * 8/2013 Santicchi ..... G07F 11/58 221/7

FOREIGN PATENT DOCUMENTS

| | | |
|---|---|---|
| GB | 500 449 | 2/1939 |
| JP | 2011 186961 | 9/2011 |
| WO | 2011/158101 | 12/2011 |

OTHER PUBLICATIONS

Search Report issued in corresponding International Patent Application No. PCT/GB2015/053766 dated Feb. 18, 2016.

* cited by examiner

ARTICLE DISPENSING APPARATUS

The invention relates to an article dispensing apparatus, in particular, but not exclusively, an apparatus for dispensing items of clothing or workwear.

In a commercial or industrial setting, such as an industrial plant, hotel or hospital, the storage and distribution of clothing and other items for personnel has traditionally been the role of a storeman, uniform shop or laundry.

It is also known to provide automatic installations for dispensing items of clothing and other small items, such as protective or safety equipment. However, such installations are typically bulky owing to the internal mechanism for retrieving stored goods, and are typically complex and expensive to produce. For example, one type of known automatic installation comprises a plurality of lockable compartments and a control system for selectively unlocking compartments to dispense articles to users.

A further type of installation that has been previously considered comprises a carousel of compartments. However, carousel-type installations may suffer from a number of disadvantages. For example, carousel-type installations may occupy a large amount of space in order to provide a useful number of angularly spaced compartments. Further, horizontal-axis carousels may only be suitable for dispensing a single type of article as the compartments must be emptied sequentially.

It is therefore desirable to provide an improved article dispensing apparatus.

According to the invention there is provided an article dispensing apparatus comprising: an endless conveyor having a plurality of moveable compartments each defined by a pair of adjacent dividers coupled to the conveyor, at least a part of each divider being pivotable between at least a closed position in which it cooperates with an adjacent divider to restrict access to the compartment defined therebetween, and an open position in which it is spaced from the said adjacent divider for dispensing an article received in the said compartment; and a guide arrangement capable of causing pivoting movement of each divider between at least the closed position and the open position.

The guide arrangement may be capable of causing pivoting movement of each divider individually between at least the closed position and the open position. The guide arrangement may be capable of causing pivoting movement of each divider individually and in turn between at least the closed position and the open position. The guide arrangement may be capable of selectively causing pivoting movement of each divider individually between at least the closed position and the open position.

Dispensing an article may comprise providing access to the compartment for withdrawal of the article, and/or discharging an article from the compartment, for example, by gravity (i.e. by opening the compartment so that the article falls from the compartment). Each divider may be biased to the closed position.

In the closed position the pivotable part of a divider (which may be a part of the divider or the whole of the divider) may cooperate with an adjacent divider to enclose the compartment defined therebetween (i.e. so that the distal end of the compartment is closed by the dividers). In the open position the pivotable part of the divider may be spaced from the said adjacent divider so as to define an opening to the compartment defined therebetween for dispensing an article received in the compartment (i.e. so that there is an opening at the distal end of the compartment).

Each divider may, in the closed position, cooperate with the respective adjacent divider to restrict access to the respective compartment by abutting the adjacent divider. Alternatively, the dividers may be configured to close towards each other to leave an opening no greater than a threshold dimension which is less than a dimension of an article to be received in a compartment. Each divider may overlap the respective adjacent divider in the closed position. Each divider may ride against or over the respective adjacent divider in the closed position.

Each divider may be pivotably coupled to the endless conveyor.

Each divider may be substantially rigid. Each divider may have a fixed bend (i.e. a bend of a fixed angle, such as about 60°) between a proximal part and a distal part of the divider. Each divider may be configured so that when proximal parts of adjacent dividers on a generally elongate portion of the endless conveyor extend generally parallel to one another the distal part of one of the dividers extends towards the other divider to restrict access to (or close) the compartment defined therebetween.

Each divider may be articulated so that a distal part of the divider is pivotable with respect to a proximal part of the divider which is coupled to the endless conveyor. Accordingly, each divider can flex around an article disposed within a corresponding compartment. Further, a divider can flex to accommodate articles of different sizes whilst still being pivotable to the closed position. Each articulated divider may be configured so that the maximum angle between the proximal part and the distal part on the trailing side of a divider is 180°.

Each divider may have a hinge, for example each divider may be scored or may have a mechanical hinge arrangement between the proximal and distal parts of the divider. The distal part may be biased to flex with respect to the proximal portion to a closed position relative an adjacent divider.

The article dispensing apparatus may comprise two or more sets of dividers of different sizes and/or two or more sets of dividers having different articulation points (i.e. hinges). For example, a first set of dividers may have proximal parts of a first length for accommodating a first type of article (e.g. shoes), and a second set of dividers may have proximal parts of a longer second length for accommodating a second type of larger article (e.g. overalls). Further, a first set of dividers may have a first cumulative length (i.e. the length of the proximal part and distal part when fully extended), whereas a second set of dividers may have a second longer cumulative length.

The guide arrangement may be arranged to engage a distal part of each divider. Each divider may have a proximal part coupled to the endless conveyor and a distal part spaced from the conveyor. The proximal and distal parts of each divider may be substantially planar.

Each divider may be provided with at least one engagement portion for engaging with the guide arrangement. The engagement portion may be an engagement projection, such as a pin or tab, arranged to engage with the guide. The or each engagement portion of each divider may be provided on one side or both sides of a distal part of the divider. The engagement portion may be provided towards a distal end of the divider.

The guide arrangement may comprise a guide track engaged with the distal part of each divider. The guide arrangement may comprising opposing guide tracks arranged to engage the distal portion of each divider. Where there are at least two sets of dividers of different sizes and/or at least two sets of dividers having different articulation points, the guide arrangement may comprise two or more corresponding guide tracks or two or more corresponding pairs of opposing guide tracks.

The guide track may encircle the endless conveyor. The guide track may be arranged so that the dividers extend obliquely with respect to the endless conveyor. The endless conveyor may be configured to rotate in a normal direction, and the guide track may be arranged so that a distal part of each divider trails the proximal part when the endless conveyor is rotated in the normal direction. The endless conveyor may be configured to rotate in the normal direction only. The article dispensing apparatus may be configured so that a direction of rotation of the endless conveyor opposite the normal direction may be prone to jamming between the distal part of the dividers and the guide track.

The guide track may be configured so that a separation distance between the guide track and the endless conveyor in a plane normal to the axis of rotation of the endless conveyor varies along the guide track to cause pivoting movement of each divider between at least the closed and open positions (i.e. as each divider is drawn along the guide track by rotation of the endless conveyor). The separation distance relates to the shortest distance of separation between each point on the guide track and the surface of the endless conveyor along the plane normal to the axis of rotation of the endless conveyor. Pivoting movement of a divider may be pivoting movement of the entire divider relative the endless conveyor (i.e. about a hinge with the endless conveyor), and/or pivoting movement of a distal part of the divider relative a proximal part of the divider (i.e. about an intermediate hinge of an articulated divider).

The guide track may be configured so that the separation distance between the guide track and the endless conveyor increases along an expansion portion of the guide track with respect to a normal direction of movement of the endless conveyor, whereby in use at least a part of a divider engaged with the expansion portion of the guide track pivots way from an adjacent divider so that an opening to the compartment defined therebetween is formed or expands for dispensing.

The guide track may be configured so that a separation distance between the guide track and the endless conveyor decreases along a contraction portion of the guide track with respect to a normal direction of movement of the endless conveyor, whereby in use at least a part of a divider engaged with the contraction portion of the guide track pivots towards an adjacent divider so that an opening to the compartment defined therebetween reduces or closes. The guide track may comprise a contraction portion followed by an expansion portion with respect to the normal direction of rotation of the endless conveyor.

The endless conveyor may be arranged to be oriented substantially vertically so that each divider is arranged for pivotable movement about a substantially horizontal axis. The guide track may define a retaining path for the dividers arranged so that compartments defined between dividers on the retaining path retain any articles received therein during operation of the endless conveyor; and wherein the guide arrangement further comprises an actuator configured to selectively cause a divider to depart from the retaining path to a discharging configuration, in which the divider is in the open position relative an adjacent divider and in which an opening to the compartment defined therebetween is formed through which an article received in the compartment can fall.

The retaining path may be configured so that each compartment defined by dividers on the retaining path is either closed to retain an article or is open and configured or positioned to retain an article by gravity.

A portion of the guide track may be bifurcated between the retaining path and a discharging path, and the actuator may be configured to selectively cause a divider to depart from the retaining path onto the discharging path whereby it moves into the discharging configuration. In other words, the portion of the guide track may be bifurcated to define part of the retaining path and a discharging path.

The storage portion of the guide track may be configured so that a separation distance between the storage portion of the guide track and the endless conveyor is at or below a threshold distance at which the distal portion of each divider pivots to the closed position relative an adjacent divider around an article received in the compartment therebetween. Accordingly, compartments defined by dividers engaged with the storage portion may closed or collapsed so that they occupy a reduced volume compared with open compartments (i.e. compartments defined by dividers in the open position)

The article dispensing apparatus may further comprise a chute for receiving an article discharged from a compartment and delivering the article to an opening in the apparatus (i.e. for collection, for example by a user of the apparatus).

The actuator may be configured to move a portion of the guide track so that a divider departs from the retaining path to a discharging configuration. The actuator may be configured to pivot the portion of the guide track so that a divider departs from the retaining path to the discharging configuration.

A storage portion of the guide track may be configured so that each divider engaged with the storage portion is in the closed position relative an adjacent divider to retain an article received in the compartment defined therebetween. The storage portion of the guide track may be configured so that the distal part of each divider engaged with the storage portion pivots to the closed position relative an adjacent divider around an article received in the compartment therebetween.

A loading portion of the guide track may be configured so that each divider engaged with the loading portion is in an open position relative an adjacent divider so that the compartment defined therebetween is open for receiving an article and so that the said compartment is configured to retain the article by gravity.

The dividers and the endless conveyor may be configured to limit the angular range of movement of each divider relative the endless conveyor so that the maximum angle between the conveyor and each trailing divider is less than 90°, less than about 80°, less than about 70°, or less than about 60°. Accordingly, each divider is constrained to extend obliquely upwardly when coupled to a portion of the conveyor moving vertically downwardly. Either the endless conveyor or each divider may comprise a pivot stop for limiting the angular range of movement.

Accordingly, the compartments defined by dividers engaging the loading portion of the guide track are arranged to be loaded with an article which may later be dispensed. The loading portion of the guide track may comprise one or more expansion portions of the guide track. The loading portion of the guide track may be configured so that dividers engaged therewith extend obliquely and upwardly from the endless conveyor for retaining articles in respective compartments by gravity.

Where the guide track defines a retaining path, the retaining path may include the storage portion and/or the loading portion of the guide track.

The article dispensing apparatus may further comprise one or more side walls arranged to enclose each compartment from the side. The guide arrangement or the guide track of the guide arrangement may be formed in or coupled to the side walls. For example, the guide track may be a groove defined in the side wall or side walls for receiving an engaging portion, such as a tab, of a divider.

The endless conveyor may extend over two spaced apart rollers. The endless conveyor may have a rear side and a front side.

The apparatus may further comprise a sensor for determining whether a compartment defined by an adjacent pair of dividers contains an article (i.e. is occupied) or is empty.

For example, the sensor may be a photo sensor or light sensor configured to determine whether a compartment is empty or occupied by determining whether an output of the sensor corresponds to a pre-determined output for an empty compartment or not. For example, each divider may be provided with a portion of reflective tape or other marker. The sensor may be configured to determine that the compartment is empty when the marker of an associated divider is detected, and is full when it is not detected.

The sensor may be disposed within the endless conveyor, and at least one link plate of the conveyor defining the proximal end of a compartment may be provided with a window or opening so that light from the compartment may be received by the sensor.

The apparatus may comprise a plurality of magazines, each magazine comprising an endless conveyor and a corresponding plurality of compartments defined by pairs of dividers. The apparatus may have a guide arrangement for each magazine. For example, the magazine may be installable and removable within the apparatus, and the apparatus may comprise a guide arrangement for each magazine with which the dividers are arranged to engage once installed.

According to a further aspect of the invention, there is provided a magazine for an article dispensing apparatus in accordance with the first aspect of the invention, the magazine comprising an endless conveyor having a plurality of moveable compartments each defined by a pair of adjacent dividers coupled to the conveyor, at least a part of each divider being pivotable between at least a closed position in which it cooperates with an adjacent divider to restrict access to the compartment defined therebetween, and an open position in which it is spaced from the said adjacent divider for dispensing an article received in the said compartment; wherein each divider is arranged for pivoting movement between at least the closed and open positions by a guide arrangement of the article dispensing apparatus.

The invention may comprise any combination of features described herein except such combinations as are mutually exclusive.

Figure 2:
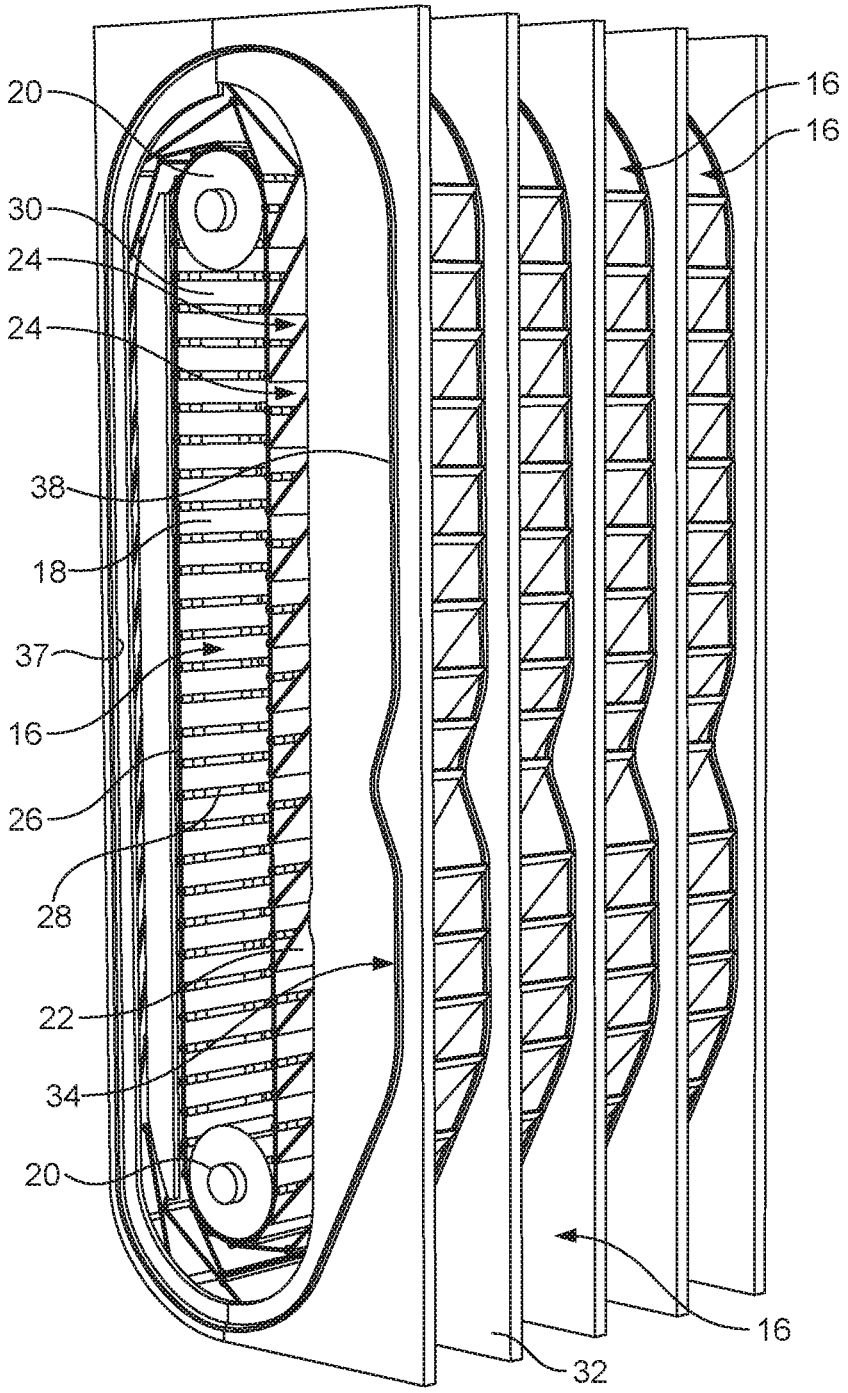
Figure 3:
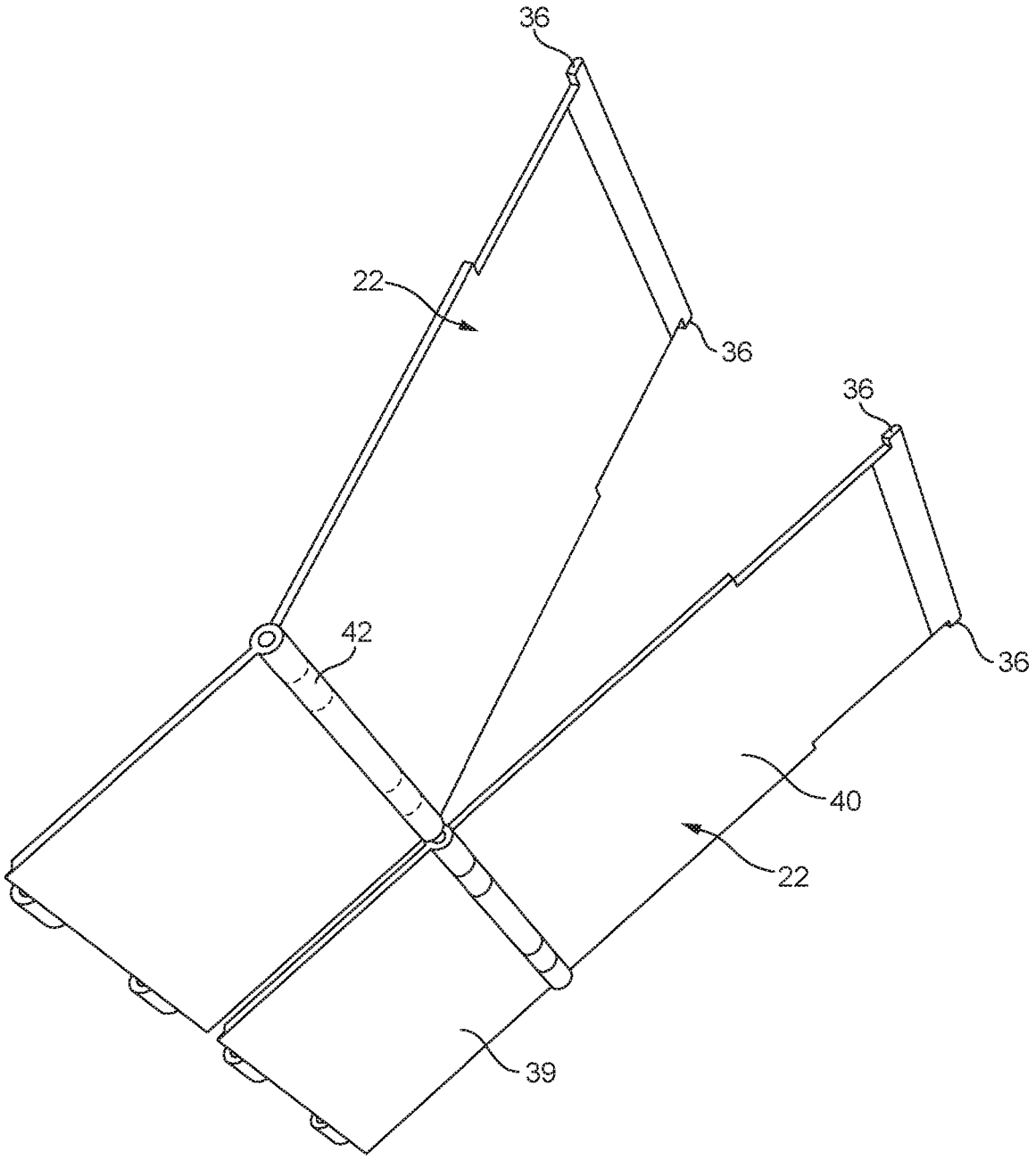
Figure 4:
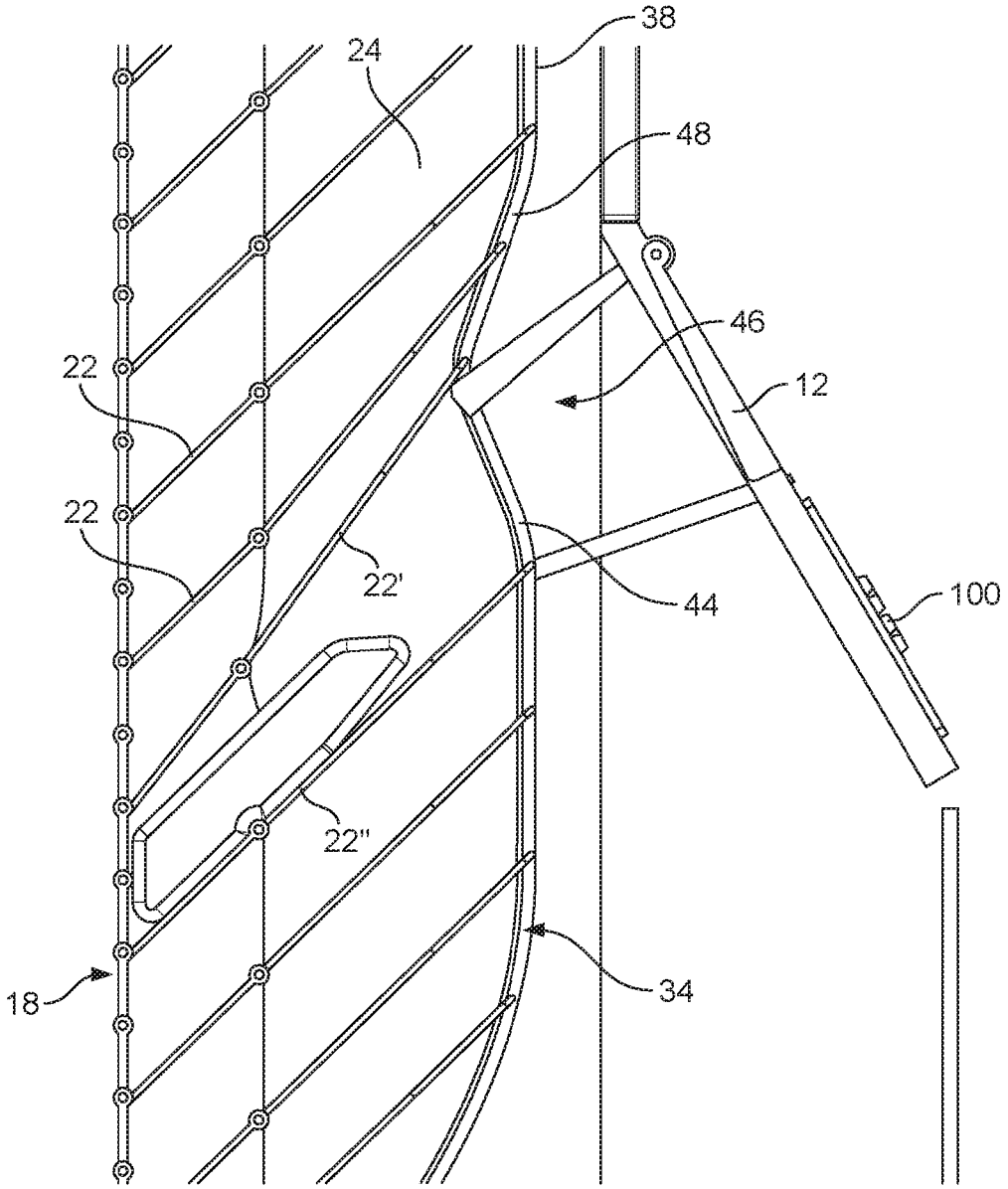
Figure 5:
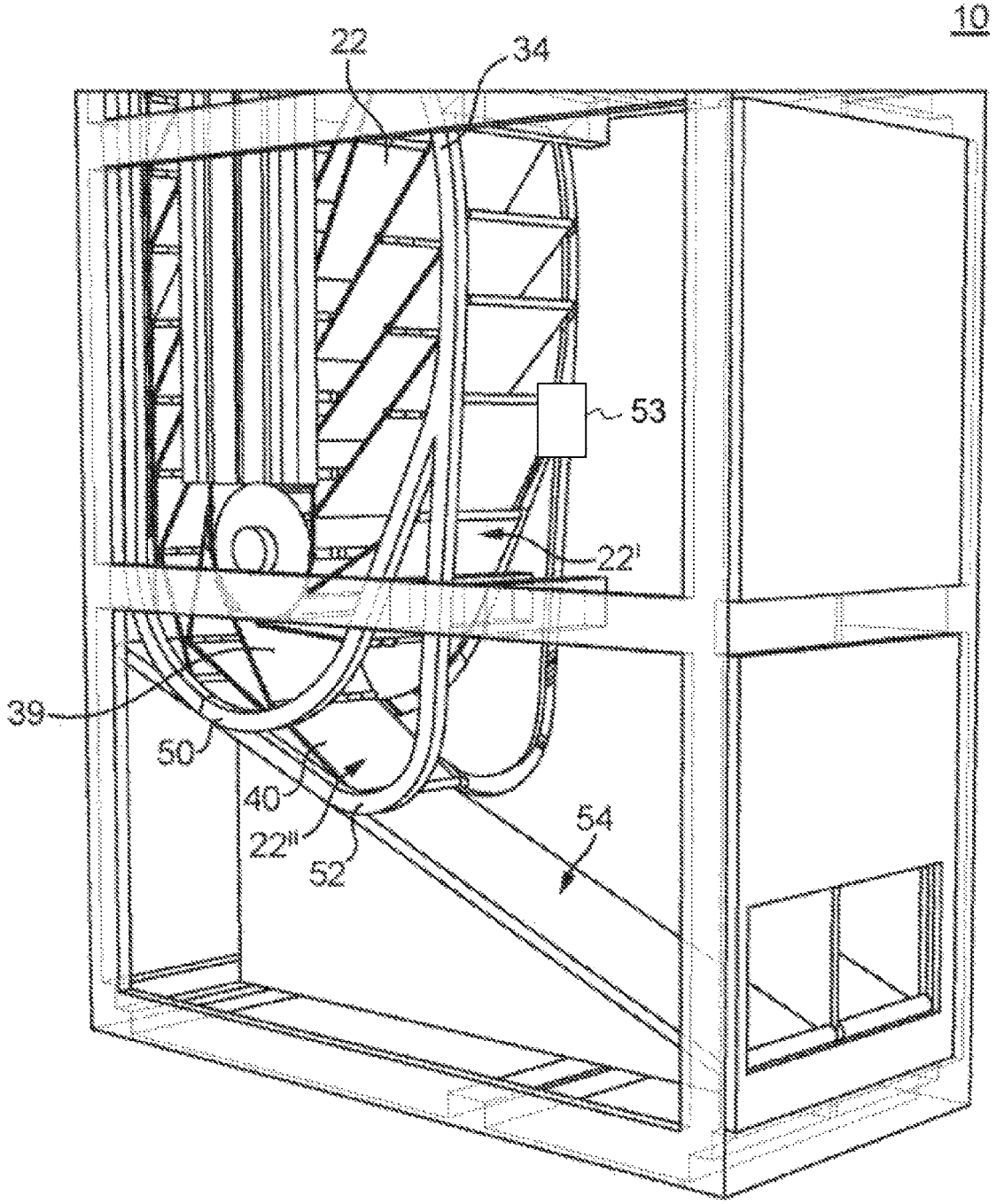
Figure 6:
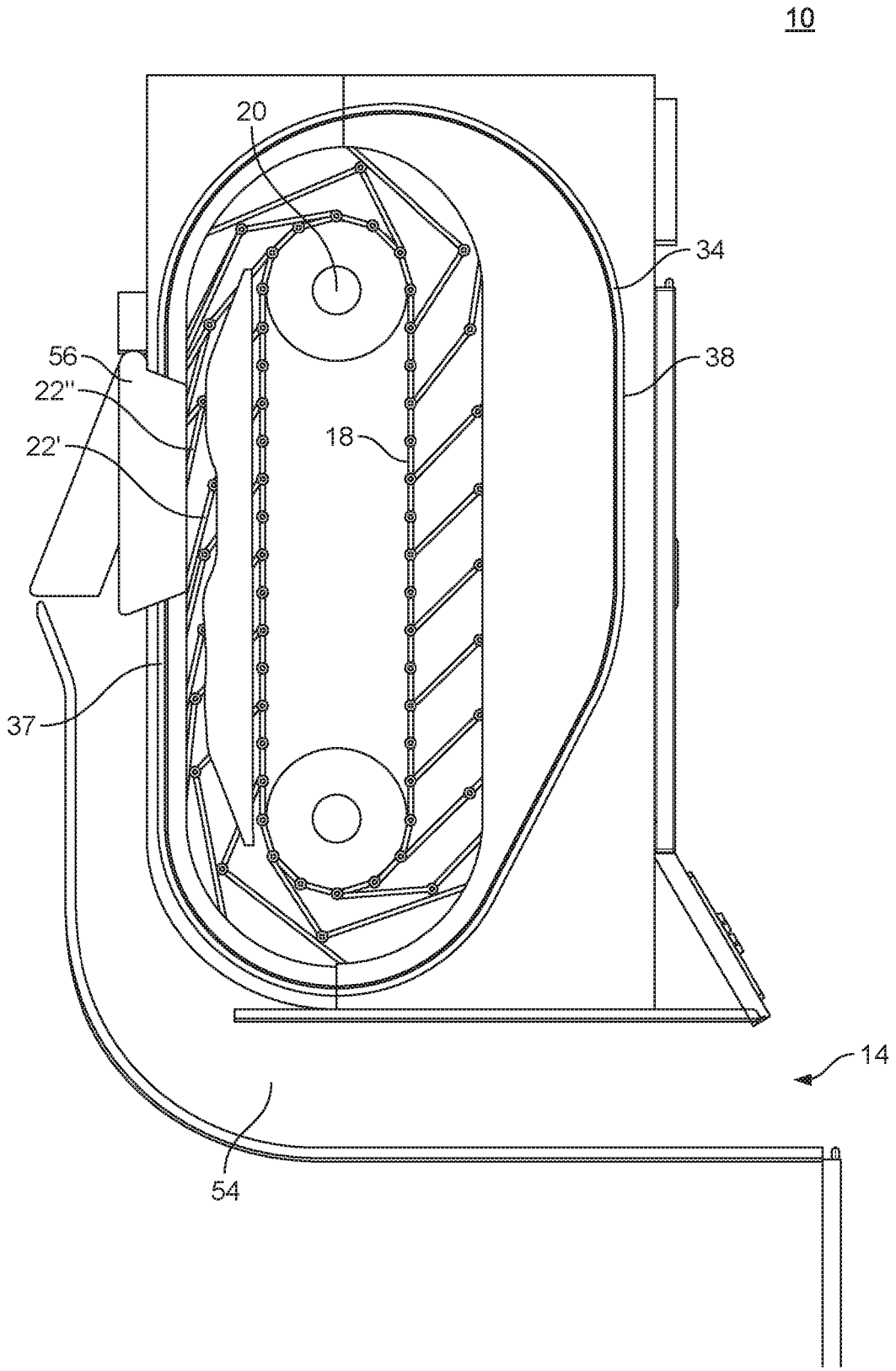
Figure 7:
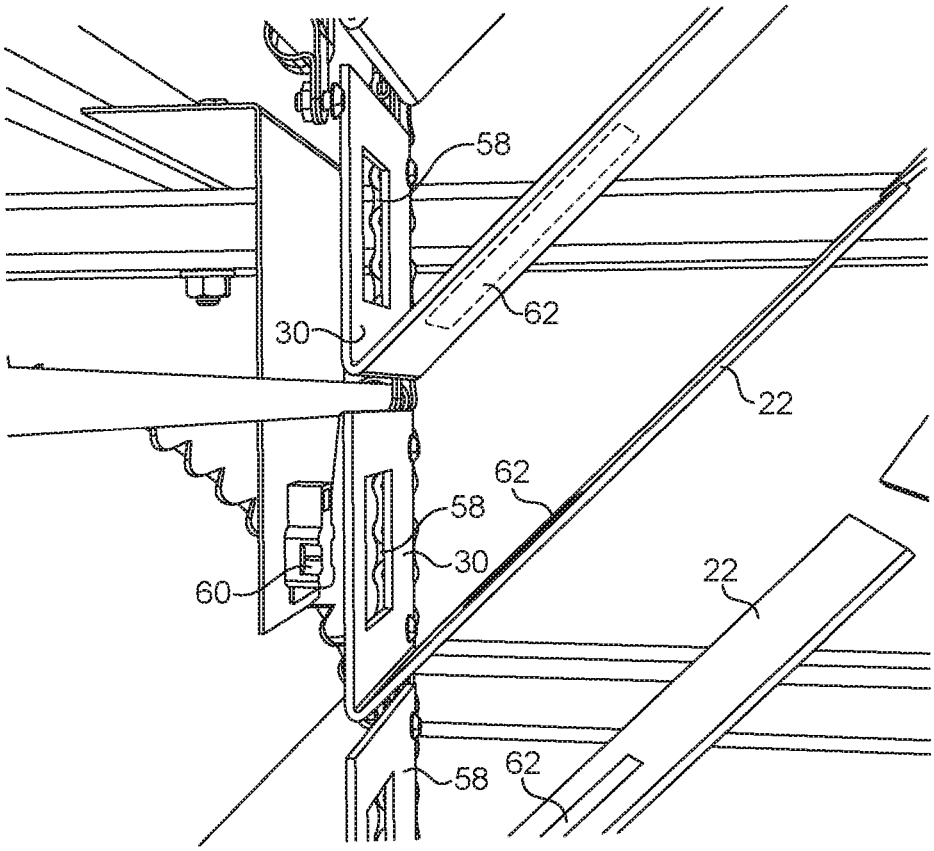

The invention will now be described, by way of example, with reference to the following drawings, in which:

FIG. 1 schematically shows a perspective cutaway view of an article dispensing apparatus according to an embodiment of the invention;

FIG. 2 schematically shows a plurality of magazines disposed within the article dispensing apparatus of FIG. 1;

FIG. 3 schematically shows two configurations of a divider for a magazine of the FIG. 2;

FIG. 4 schematically shows dividers of a magazines in the region of an expansion portion of a guide track for the magazine;

FIG. 5 schematically shows dividers of a magazine in the region of a discharging path of the guide track;

FIG. 6 schematically shows dividers of a magazine in the region of a movable discharging portion of the guide track; and FIG. 7 schematically shows a cutaway view of a magazine including a sensor for determining whether a compartment is empty.

FIG. 1 shows a cutaway view of an article dispensing apparatus in the form of a freestanding automatic cabinet 10. The cabinet has four dispensing doors 12 through which articles may be manually withdrawn from the cabinet, and a chute opening 14 for discharging articles from within the cabinet 10 for a user to retrieve.

As shown in FIG. 2, within the automatic cabinet 10 there are four magazines 16 arranged side-by-side for storing and dispensing a plurality of articles. Each magazine 16 comprises a vertically-oriented link-type endless conveyor 18 formed over two horizontal-axis rollers 20, and a plurality of dividers 22 defining movable compartments 24 on the conveyor 18.

One of the rollers 20 of each conveyor 18 is provided with a stepper motor (not shown) to cause the respective conveyor 18 to rotate. The rollers 20 for each conveyor 18 are vertically separated so that each endless conveyor 18 comprises an elongate front side towards the dispensing doors 12 (FIG. 1) and an opposing elongate rear side. Each conveyor 18 comprises two chains 26 extending around the rollers 20 and supporting a plurality of regularly spaced link rods 28 extending therebetween. Link plates 30 are coupled to the rods 28 to form a base or proximal end of each compartment 24.

The dividers 22 are pivotably coupled to each endless conveyor 18. In this embodiment, a divider 22 is coupled to each conveyor at every other link rod 28 of the conveyor 18, although in other embodiments the spacing between dividers 22 may be larger or smaller, or may be variable around the conveyor 18.

Briefly referring to FIG. 3, in this embodiment each divider is articulated between a proximal part 39 that is pivotable coupled to an endless conveyor 18 (FIG. 2) and a distal part 40. The proximal and distal parts 39, 40 are coupled at a hinge 42, but in other embodiments the divider 22 may be formed from a scored sheet of material.

Each divider 22 is provided with an engagement portion towards its distal end for engaging with a guide track 34 (FIG. 2), as described in detail below. In this embodiment, the engagement portion of each divider is in the form of a pair of guide tabs 36 provided on opposite sides of the distal end of the divider. The opposing tabs 36 ride are arranged to ride within guide tracks 34 in side walls on either side of the divider 22.

Referring back to FIG. 2, each pair of adjacent dividers 22 defines a compartment 24 therebetween on the conveyor 18. Each compartment 24 is additionally bounded on the sides by vertical side walls 32 disposed between the magazines 16 and at its proximal end by one or more link plates 30 coupled to the conveyor. The distal end of each compartment 24 can be opened and closed by pivoting movement of the dividers 22. In particular, each divider can pivot towards an adjacent divider 22 to a closed position in which the dividers cooperate to restrict access to the compartment defined therebetween, and can pivot away from the adjacent divider 22 to an open position in which an article within the compartment 24 can be accessed.

Each vertical side wall 32 comprises a guide track 34 that extends around the conveyor. In this embodiment the guide track 34 is a groove, but in other embodiments may be a slot extending through the side wall 32 or a rail coupled to the side wall 32 or another part of the magazine 16 or apparatus 10. The guide track 34 is configured to engage with an engagement portion of each divider 22.

The guide track 34 defines a path for the dividers 22 to follow as each conveyor 18 rotates around the rollers 20. At all points on the path, a separation distance between the endless conveyor 18 and the guide tracks 34 is less than the length of a fully extended divider 22 so that the dividers 22 are required to trail from the pivotable connection with the conveyor 18 with respect to a normal direction of motion of the conveyor (the clockwise direction in the drawings, i.e. downward on the front side and upward at the rear). The separation distance relates to the distance in a plane perpendicular to the horizontal axis of the rollers (i.e. a plane parallel with the side walls 32). The conveyor 18 is configured to rotate in one direction only, and therefore the dividers 22 will always trail from the attachment point with the conveyor 18, rather than be pushed by the conveyor, which could result in jamming.

The separation distance varies around the endless conveyor in order to control pivoting motion of the divider 22. In particular, the separation distance dictates the pivoting motion of one divider 22 with respect to its adjacent dividers between the closed and open positions. The separation distance between the guide track 34 and the endless conveyor 18 is generally greater over the elongate front side of the endless conveyor than over the elongate rear side. In particular, the guide track 34 has a storage portion 37 at the rear side of the conveyor where the separation distance is relatively small so each divider 22 engaged therewith pivots to the closed position relative an adjacent diver so as to retain any articles contained in the compartment 24 defined therebetween.

Conversely, at the front side of the conveyor above the dispensing doors 12, the guide track 34 has a loading portion 38 where the separation distance is relatively large so that each divider 22 engaged therewith pivots to the open position relative an adjacent divider so that articles can be loaded into the compartment 24 defined therebetween. In particular, front-side cabinet doors (not shown) are provided which can be opened to insert articles into compartments 24 defined by dividers 22 engaging the loading portion of the guide track 34.

The dividers 22 are configured to extend obliquely upwards over the front side of the conveyor 18, as shown in FIG. 2 and as will be described below. Therefore, despite being open over the front side of the conveyor, articles within compartments 24 on the front side of the conveyor 18 are held by gravity. In particular, the proximal end of the proximal part 39 of each divider 22 is configured to engage with the conveyor 18, in particular the link plates 30, so that the angle between the conveyor 18 and the proximal part 39 (FIG. 3) is limited. Specifically, the proximal part 39 of each divider 22 is configured so that, when the divider is on the front elongate portion of the conveyor 18, the maximum angle between the conveyor and the vertically extending conveyor 18 is 60°. Accordingly, the dividers 22 will bear the weight of and retain articles when they extend along an upwardly inclined direction, rather than pivoting downwardly.

The guide track 34 therefore defines a retaining path for the dividers 22, whereby dividers 22 following the retaining path serve to retain articles within the compartments 24 defined therebetween at all points around the conveyor 18, either by virtue of the compartments being closed (the storage portion 37 of the guide track 34), or open but arranged to retain an article by gravity (the front side of the guide track 34, including the loading portion 38). The conveyor 18 can therefore be continuously rotated without necessarily dispensing an article.

Three dispensing arrangements for the article dispensing apparatus 10 and their operation will now be described. The dispensing arrangements include door access (FIG. 4), chute access guided by a guide track (FIG. 5), and chute access by movement of the guide track (FIG. 6).

FIG. 4 shows the first dispensing arrangement in the region of the dispensing doors 12.

At the front side of the conveyor 18 the guide track 34 comprises the loading portion 38, a contraction portion 48 and an expansion portion 44. As shown in FIG. 4, the separation distance between the loading, contraction and expansion portions of the guide track 34 and the endless conveyor is such that each divider 22 engaged therewith is in the open position relative a following divider 22. Therefore the respective compartments 24 are open and extend obliquely upwardly to hold articles by gravity.

In normal use, the cabinet doors in front of the loading portion are locked and manual access to the compartments 24 is only provided via the selectively openable dispensing doors 12 and an access chute 46 extending towards the distal ends of the compartments 24 that move past the doors 12. In order to improve access to a compartment 24 located behind the dispensing doors 12, the guide track 34 includes an expansion portion 44 configured to widen an opening to the compartment 24.

The expansion portion 44 of the guide track extends away from the conveyor 18 so that the separation distance between the conveyor 18 and the guide track 34 increases along the expansion portion 44 with respect to the normal direction of rotation of the conveyor 18. Accordingly, as the guide pins 36 of a leading divider 22" engage with the expansion portion 44, the already-extended leading divider 22" tends to pivot downwardly and away from a following divider 22' so as to form or increase the size of the opening between them, thus widening the compartment so that a user may reach around an article disposed therein to withdraw it.

Prior to the expansion portion 44 of the guide track, there is a contraction portion 48 over which the separation distance decreases with respect to the normal direction of rotation of the conveyor 18. The contraction portion 48 is arranged so that a leading divider engaged with the contraction portion pivots towards a following divider as it moves along the contraction portion 48, so that the leading divider moves towards a closed position.

It will be appreciated that for arrangements in which the dividers are already extended and limited by pivot stops prior to an expansion portion 48, for example over the loading portion 38 shown in FIGS. 2 and 4, a preceding contraction portion allows for an opening to a compartment 24 to ultimately be widened over the expansion portion 48. In contrast, if the dividers are not fully expanded or the compartments therebetween are not fully open prior to an expansion portion 48, a contraction portion may not be necessary.

In use, a user operates the controls 100 of the apparatus 10 to select an article to be dispensed. A control system for the apparatus 10 determines the location of the article within one of the magazines and rotates the respective conveyor 18 so that the compartment 24 in which the article is retained is disposed behind one of the dispensing doors 12. The apparatus 10 unlocks the respective dispensing door 12 and the user reaches into the compartment 24. The opening to the compartment 24 is expanded relative to the openings to the compartments 24 above, since the leading divider 22" of the compartment 24 has moved over the expansion portion 48 to pivot away from the following divider to an expanded position.

FIG. 5 shows a second dispensing arrangement for the apparatus 10 which is arranged to selectively dispense an article from a magazine by deflecting a divider 22 from the retaining path onto a discharging path.

In this second dispensing arrangement, the guide track 34 comprises a bifurcated portion towards the lower end of the conveyor 18 including an upper portion 50 which forms part of the retaining path of the guide track 34, and a lower portion 52 which defines a discharging path for one or more dividers 22.

As shown in FIG. 5, the separation distance between the guide track 34 and the endless conveyor increases over the discharging path so that a leading divider 22" pivots away from a following divider 22' to open the compartment 24 defined therebetween. Further, the discharging path is defined so that the leading divider 22" pivots to extend downwardly towards the chute 54 so that an article within the respective compartment slides outwardly over the divider 22 onto the chute 54. The discharging path converges again with the retaining path towards the rear side of the conveyor.

The apparatus 10 further comprises an actuator (not shown) for selectively directing a divider 22 to follow the discharging path. For example, the actuator may be arranged to cause a pivotable gate defining a portion of the guide track 34 to pivot so that an engaging pin of a divider 22 follows the discharging path rather than the retaining path.

In use, the control system of the apparatus 10 determines the location of a compartment containing an article to be dispensed, and rotates the respective magazine so that the compartment approaches the bifurcated portion of the guide track 34. The control system controls the actuator (not shown) so that the leading divider 22" of the compartment containing the article to be dispensed follows the discharging path, rather than the retaining path, of the bifurcated portion of the guide track 34. As the leading divider 22" for the compartment follows the discharging path, the article contained in the respective compartment slides out over the leading divider into the chute 54 to the chute opening 14 formed in the front of the apparatus 10 for collection by a user.

FIG. 6 shows a third dispensing arrangement for a second embodiment of the apparatus 10. In the third dispensing arrangement, a movable portion of the guide track 34 is provided for selectively dispensing an article from the rear of the conveyor 18.

The second embodiment of the dispensing apparatus 10 differs from the first embodiment in that the conveyor 18 is of lesser height, and there are no dispensing doors (the first dispensing arrangement) and no bifurcated portion of the guide track 34 (the second dispensing arrangement). In the second embodiment, the dispensing apparatus 10 comprises the third dispensing arrangement only, as described in detail below.

In the third dispensing arrangement, a movable portion 56 of the guide track 34 is provided at the rear of the conveyor and partly defines the storage portion 37 of the guide track 34. The movable portion 56 of the guide track 34 comprises a pivotable member provided with a groove that defines a portion of the guide track 34. The movable portion 56 is pivotably attached at its upper end to the vertical side member. An actuator (not shown) is provided for selectively pivoting the movable portion 56 between a retracted position in which it is aligned with the adjacent portions of the guide track 34 and a discharging position in which the lower end of the movable portion 56 moves rearwardly away from the conveyor 18. The movable portion 56 is arranged so that, when it moves to the discharging position, a leading divider 22" engaged with the movable portion 56 moves away from the retaining path to a discharging position in which it is in the open position relative to the following divider 22' of the compartment.

Since the movable portion 56 of the guide track 34 is located at the rear of the conveyor 18 where the dividers 22 extend obliquely downwardly from the conveyor, the divider 22" is arranged so that upon moving to the open position, an article in the compartment defined by the leading divider 22" falls from the compartment into a chute 54 extending down the rear side of the conveyor 18 and is thereby dispensed to the chute opening 14.

In use, the control system for the apparatus 10 determines that an article within a specific compartment is to be dispensed based on instructions from a user. The control system rotates the respective magazine so that the leading divider 22" of the compartment is engaged with the movable portion 56 of the guide track. The control system then causes the actuator (not shown) to move the movable portion 56 to the discharging position so that the article within the compartment falls through an opening formed at the distal end of the compartment, and travels through the chute 54 to the chute opening 14 for collection by the user.

The article dispensing apparatus 10 is configured to maintain a database of available articles and their location within the magazines 16. A user can select an article, or the control system may select an article for the user, depending on the user's inputs to the controls 100 or identification of the user to the apparatus 10, such as by presenting a user identification card.

In an embodiment of the invention shown in FIG. 7, the article dispensing apparatus is configured to determine whether a compartment is empty or contains an article. Each link plate 30 is provided with a window 58 of transparent plastic, and a photo sensor 60 is disposed within the conveyor 18 and aligned with the windows 58 of the link plates 30 so that, as the window 58 of a link plate 30 passes the photo sensor 60, light from the respective compartment is detected by the photo sensor 60. In this embodiment, each divider 22 is provided with a reflective strip 62 on the proximal part 39, positioned so that if the compartment is empty, light reflected by the reflective strip 62 will be detectable by the photo sensor 60 as the divider 22 (and respective compartment) passes the photo sensor 60. The photo sensor 60 may also be provided with a light source. A processing means is configured to interpret a signal from the photo sensor 60 corresponding to the light received at the sensor, and to determine, on the basis of the signal, whether light from a reflective strip 62 is received and therefore whether the respective compartment is empty.

The apparatus may be configured so that each compartment is associated with a specific type of article, and therefore the database mapping of articles to compartments need not be updated except for indicating whether an article is present or absent in each compartment. Alternatively, the apparatus may be configured so that each compartment may accept two or more different types of articles. For example, an operator may scan an RFID tag or barcode on an article before or whilst loading it through a dispensing door into an empty compartment. The control system may then associate the compartment with the details of the article for later retrieval.

Further, the control system may locate empty compartments that are suitable for an article presented to the apparatus for loading by an operator. For example, an operator may scan the RFID tag or barcode on an article, and the control system may, on the basis of information about the article, select an appropriate empty compartment, rotate the corresponding conveyor and unlock or illuminate a dispensing door through which the article can be loaded.

Further, articles may be loaded into the compartment by opening the cabinet doors to expose the open compartments defined by dividers engaged with the loading portion of the guide track. The compartments may be loaded according to a pre-determined layout, or the control system may indicate which articles are to be loaded into which compartments. The dividers may be marked so that the operator can determine the appropriate compartments for loading each article.

Further, the compartments could be loaded in an unorganised manner, and an RFID scanner within the apparatus may be provided to detect an RFID tag associated with an article and associate the article with the corresponding compartment in the database.

A manual control may be provided for rotating the conveyor for a loading operation. The manual control may comprise two buttons located on opposite sides of the conveyors and behind the cabinet doors. The manual control may be configured so that both buttons must be pressed to cause rotation of the conveyors, so as to ensure that an operators hands are both clear of the open compartments during rotation.

It will be appreciated that where each divider is provided with engagement portions on opposing sides it is arranged to engage with a pair of opposing guide tracks having equivalent storage, loading, expansion, contraction, discharging (dispensing path) and/or movable portions.

Although embodiments of the invention have been described in which each divider is articulated between a proximal part and a distal part, it will be appreciated that in other embodiments the dividers may not be articulated. In particular, the dividers may have a fixed-angle bend between a proximal part and a distal part, and be pivotable only at the attachment to the endless conveyor.

The invention claimed is:

1. An article dispensing apparatus comprising:

an endless conveyor having a plurality of moveable compartments each defined by a pair of adjacent dividers each pivotably coupled to the conveyor at a hinge with the endless conveyer, each of said adjacent dividers configured to pivot relative to the endless conveyor about said hinge with the endless conveyor, at least a part of each divider being pivotable between at least a closed position in which it cooperates with an adjacent divider so that a distal end of the compartment is closed by the dividers and access to the compartment defined therebetween is restricted, and an open position in which it is spaced from the said adjacent divider for dispensing an article received in the said compartment; and a guide arrangement capable of causing pivoting movement of each divider between at least the closed position and the open position;

wherein the guide arrangement comprises a guide track engaged with a distal part of each divider;

wherein the guide track is configured so that a separation distance between the guide track and the endless conveyor in a plane normal to an axis of rotation of the endless conveyor varies along the guide track to cause pivoting movement of each divider between at least the closed and open positions;

wherein the guide track is configured so that the separation distance between the guide track and the endless conveyor increases along an expansion portion of the guide track with respect to a normal direction of movement of the endless conveyor, whereby in use at least a part of a divider engaged with the expansion portion of the guide track pivots away from an adjacent divider so that an opening to the compartment defined therebetween is formed or expands for dispensing.

2. An article dispensing apparatus according to claim 1, wherein each divider is articulated so that the distal part of the divider is pivotable with respect to a proximal part of the divider which is coupled to the endless conveyor.

3. An article dispensing apparatus according to claim 2, wherein a storage portion of the guide track is configured so that each divider engaged with the storage portion is in the closed position relative an adjacent divider to retain an article received in the compartment defined therebetween and the distal part of each divider engaged with the storage portion pivots to the closed position relative an adjacent divider around an article received in the compartment therebetween.

4. An article dispensing apparatus according to claim 3, wherein each divider is provided with at least one engagement portion for engaging with the guide arrangement.

5. An article dispensing apparatus according to claim 3, wherein the guide track encircles the endless conveyor.

6. An article dispensing apparatus according claim 3, wherein a storage portion of the guide track is configured so that each divider engaged with the storage portion is in the closed position relative an adjacent divider to retain an article received in the compartment defined therebetween.

7. An article dispensing apparatus according to claim 3, wherein a loading portion of the guide track is configured so that each divider engaged with the loading portion extends obliquely and upwardly from the endless conveyor and is in an open position relative an adjacent divider so that the compartment defined therebetween is open for receiving an article and so that the said compartment is configured to retain the article by gravity.

8. An article dispensing apparatus according to claim 1, wherein each divider is provided with at least one engagement portion for engaging with the guide arrangement.

9. An article dispensing apparatus according to claim 1, wherein the guide track encircles the endless conveyor.

10. An article dispensing apparatus according claim 1, wherein a storage portion of the guide track is configured so that each divider engaged with the storage portion is in the closed position relative an adjacent divider to retain an article received in the compartment defined therebetween.

11. An article dispensing apparatus according to claim 1, wherein a loading portion of the guide track is configured so that each divider engaged with the loading portion extends obliquely and upwardly from the endless conveyor and is in an open position relative an adjacent divider so that the compartment defined therebetween is open for receiving an article and so that the said compartment is configured to retain the article by gravity.

12. An article dispensing apparatus comprising:

an endless conveyor having a plurality of moveable compartments each defined by a pair of adjacent dividers each pivotably coupled to the conveyor at a hinge with the endless conveyer, each of said adjacent dividers configured to pivot relative to the endless conveyor about said hinge with the endless conveyor, at least a part of each divider being pivotable between at least a closed position in which it cooperates with an adjacent divider so that a distal end of the compartment is closed by the dividers and access to the compartment defined therebetween is restricted, and an open position in which it is spaced from the said adjacent divider for dispensing an article received in the said compartment; and a guide arrangement capable of causing pivoting movement of each divider between at least the closed position and the open position;

wherein the guide arrangement comprises a guide track engaged with a distal part of each divider;

wherein the endless conveyor is arranged to be oriented substantially vertically so that each divider is arranged for pivotable movement about a substantially horizontal axis;

wherein the guide track defines a retaining path for the dividers arranged so that compartments defined between dividers on the retaining path retain any articles received therein during operation of the endless conveyor; and wherein the guide arrangement further comprises an actuator configured to selectively cause a divider to depart from the retaining path to a discharging configuration, in which the divider is in the open position relative an adjacent divider and in which an opening to the compartment defined therebetween is formed through which an article received in the compartment can fall.

13. An article dispensing apparatus according to claim 12, wherein a portion of the guide track is bifurcated between the retaining path and a discharging path, and wherein the actuator is configured to selectively cause a divider to depart from the retaining path onto the discharging path whereby it moves into the discharging configuration.

14. An article dispensing apparatus according to claim 12, wherein the actuator is configured to move a portion of the guide track so that a divider departs from the retaining path to a discharging configuration.

15. An article dispensing apparatus according to claim 12, wherein each divider is articulated so that the distal part of the divider is pivotable with respect to a proximal part of the divider which is coupled to the endless conveyor.

16. An article dispensing apparatus according to claim 12, wherein each divider is provided with at least one engagement portion for engaging with the guide arrangement.

17. An article dispensing apparatus according to claim 12, wherein the guide track encircles the endless conveyor.

18. An article dispensing apparatus according claim 12, wherein a storage portion of the guide track is configured so that each divider engaged with the storage portion is in the closed position relative an adjacent divider to retain an article received in the compartment defined therebetween.

19. An article dispensing apparatus according to claim 12, wherein a loading portion of the guide track is configured so that each divider engaged with the loading portion extends obliquely and upwardly from the endless conveyor and is in an open position relative an adjacent divider so that the compartment defined therebetween is open for receiving an article and so that the said compartment is configured to retain the article by gravity.

* * * * *